US010208773B2

(12) United States Patent
Carpenter et al.

(10) Patent No.: US 10,208,773 B2
(45) Date of Patent: Feb. 19, 2019

(54) SYSTEM FOR HYDRAULIC PUMP HEALTH MONITORING

(71) Applicant: Caterpillar Inc., Peoria, IL (US)

(72) Inventors: Richard A. Carpenter, Chillicothe, IL (US); Solimar Reyes-Rodriguez, Edwards, IL (US)

(73) Assignee: Caterpillar Inc., Deerfield, IL (US)

( * ) Notice: Subject to any disclaimer, the term of this patent is extended or adjusted under 35 U.S.C. 154(b) by 203 days.

(21) Appl. No.: 15/244,471

(22) Filed: Aug. 23, 2016

(65) Prior Publication Data

US 2018/0058482 A1 Mar. 1, 2018

(51) Int. Cl.

| | |
|---|---|
| ***F15B 20/00*** | (2006.01) |
| ***F04B 51/00*** | (2006.01) |
| ***E02F 9/22*** | (2006.01) |
| ***E02F 9/26*** | (2006.01) |
| ***F04B 49/06*** | (2006.01) |

(52) U.S. Cl.

CPC ..... *F15B 20/00* (2013.01); *E02F 9/226* (2013.01); *E02F 9/26* (2013.01); *F04B 49/065* (2013.01); *F04B 51/00* (2013.01); *F04B 2205/05* (2013.01); *F04B 2205/09* (2013.01); *F04B 2205/11* (2013.01); *F04B 2205/15* (2013.01); *F04B 2205/501* (2013.01)

(58) Field of Classification Search

CPC ..... F15B 2211/86; F15B 2211/865; F15B 2211/87; F15B 2211/8755

See application file for complete search history.

(56) References Cited

U.S. PATENT DOCUMENTS

| | | | | |
|---|---|---|---|---|
| 5,563,351 | A * | 10/1996 | Miller | F04B 49/10 73/861.42 |
| 5,825,487 | A | 10/1998 | Felbinger et al. | |
| 6,260,004 | B1 * | 7/2001 | Hays | G05B 23/0235 702/130 |
| 6,352,001 | B1 * | 3/2002 | Wickert | G01F 1/44 73/861.52 |
| 6,392,562 | B1 * | 5/2002 | Boston | G01N 15/0656 324/204 |
| 6,463,949 | B2 * | 10/2002 | Ferguson | F04B 49/065 137/2 |
| 6,829,542 | B1 * | 12/2004 | Reynolds | F04B 43/0081 702/34 |

(Continued)

*Primary Examiner* — F. Daniel Lopez
*Assistant Examiner* — Matthew Wiblin
(74) *Attorney, Agent, or Firm* — Miller, Matthias & Hull

(57) ABSTRACT

A system may comprise a first sensor; a second sensor; and an electronic control module. The electronic control module may be configured to determine a flow of the fluid based on information regarding the pressure from the first sensor and information regarding the temperature from the second sensor; determine a portion of the flow of the fluid that is directed to a particle counter of the machine; receive, from the particle counter, information identifying a quantity of particles in the portion of the flow of the fluid; determine a quality of the fluid based on the quantity of particles; determine whether the flow of the fluid exceeds a flow threshold or whether the quality of the fluid is less than a quality threshold; and take a remedial action when the flow of the fluid exceeds the flow threshold or the quality of the fluid is less than the quality threshold.

20 Claims, 4 Drawing Sheets

(56) References Cited

U.S. PATENT DOCUMENTS

| | | | | |
|---|---|---|---|---|
| 7,082,758 | B2 * | 8/2006 | Kageyama | E02F 9/20 60/329 |
| 7,689,368 | B2 * | 3/2010 | Douglas | G01N 35/00722 324/71.1 |
| 8,800,383 | B2 * | 8/2014 | Bates | G01F 1/363 73/861.61 |
| 9,140,255 | B2 * | 9/2015 | Wetherill | G01F 15/14 |
| 2016/0138624 | A1 * | 5/2016 | Oftelie | F15B 21/044 701/50 |

* cited by examiner

SYSTEM FOR HYDRAULIC PUMP HEALTH MONITORING

TECHNICAL FIELD

The present disclosure generally relates to a hydraulic pump of a machine, and more particularly relates to monitoring the health of the hydraulic pump.

BACKGROUND

A hydraulic pump may be included in a hydraulic system of a machine to provide power to different components of the machine. Over a period of time, components of the hydraulic pump may experience wear. Accordingly, the hydraulic pump may not perform efficiently, may malfunction, and, eventually, may experience a failure. The malfunction or failure of the hydraulic pump may cause a malfunction and/or a failure of the components of the machine powered by the hydraulic pump, which may possibly cause a malfunction and/or a failure of the machine.

It may be desirable to predict a failure and/or detect an impeding failure of the hydraulic pump to, thereby, prevent the failure of the hydraulic pump. However, predicting the failure and/or detecting the impeding failure of the hydraulic pump may be a difficult task.

U.S. Pat. No. 8,800,383 (hereinafter the "383 patent") is directed to monitoring flow rate in aerosol particle counters. In this regard, the '383 patent refers to a particle sensor with a particle counter and a flow measurement orifice. The flow measurement orifice includes a differential pressure sensor that measures differential pressure across the flow measurement orifice during a particle sensor operation and a critical flow orifice.

SUMMARY OF THE INVENTION

In some embodiments, a method may comprise receiving, by an electronic control module of the machine and from a first sensor of the machine, information regarding a pressure of a fluid of a hydraulic pump of the machine; receiving, by the electronic control module and from a second sensor of the machine, information regarding a temperature of the fluid; determining, by the electronic control module, a flow of the fluid based on the information regarding the pressure and the information regarding the temperature; determining, by the electronic control module, a portion of the flow of the fluid that is directed to a particle counter of the machine; receiving, by the electronic control module and from the particle counter, information regarding particles in the portion of the flow of the fluid; determining, by the electronic control module, a quality of the fluid based on the information regarding the particles in the portion of the flow of the fluid; determining, by the electronic control module, whether the flow of the fluid exceeds a flow threshold or whether the quality of the fluid is less than a quality threshold to determine the health of the hydraulic pump; and taking, by the electronic control module, a remedial action when at least one of the flow of the fluid exceeds the flow threshold or the quality of the fluid is less than the quality threshold In some embodiments, a system may comprise a first sensor configured to transmit information regarding a pressure of a fluid of a machine; a second sensor configured to transmit information regarding a temperature of the fluid; and an electronic control module configured to: determine a flow of the fluid based on the information regarding the pressure and the information regarding the temperature; determine a portion of the flow of the fluid that is directed to a particle counter of the machine; receive, from the particle counter, information regarding particles in the portion of the flow of the fluid; determine a quality of the fluid based on the information regarding the particles in the portion of the flow of the fluid; determine whether the flow of the fluid exceeds a flow threshold or whether the quality of the fluid is less than a quality threshold; and take a remedial action when at least one of the flow of the fluid exceeds the flow threshold or the quality of the fluid is less than the quality threshold.

In some embodiments, a machine may comprise a first sensor configured to transmit information regarding a pressure of a fluid of the machine; a second sensor configured to transmit information regarding a temperature of the fluid; and an electronic control module configured to: determine a flow of the fluid based on the information regarding the pressure and the information regarding the temperature; determine a portion of the flow of the fluid that is directed to a particle counter of the machine; receive, from the particle counter, information identifying a quantity of particles in the portion of the flow of the fluid; determine a quality of the fluid based on the quantity of particles in the portion of the flow of the fluid; determine whether the flow of the fluid exceeds a flow threshold or whether the quality of the fluid is less than a quality threshold; and take a remedial action when at least one of the flow of the fluid exceeds the flow threshold or the quality of the fluid is less than the quality threshold.

DETAILED DESCRIPTION

The following detailed description refers to the accompanying drawings. The same reference numbers in different drawings may identify the same or similar elements.

Figure 1:
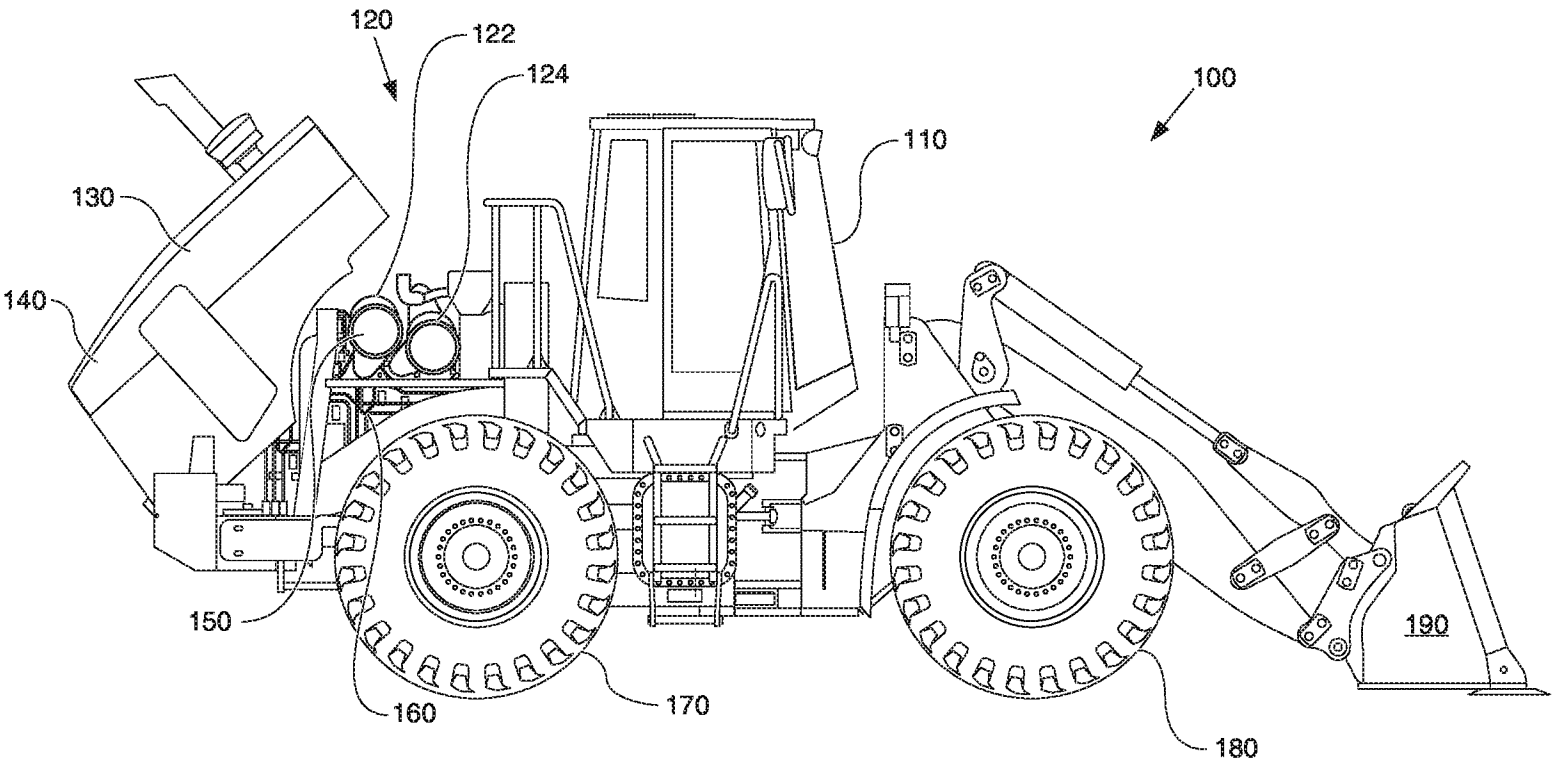
FIG. 1 is a side view of a machine according to an embodiment of the present disclosure.

FIG. 1 is a side view of a machine 100 (or a vehicle), according to an embodiment of the present disclosure, that includes a system for hydraulic health pump monitoring of the present disclosure. In some implementations, machine 100 may include a wheel loader, an off-highway truck, an on-highway truck, a dump truck, an articulated truck, a motor grader, a bull dozer, a tracker loader, a compactor, an excavator, a backhoe loader, a pavers and/or any machine that may include a hydraulic pump. In this regard, machine 100 may be any machine associated with various industrial applications, including, but not limited to, mining, agriculture, forestry, construction, and/or other industrial applications.

As illustrated in FIG. 1, machine 100 may include a wheel loader. In this regard, machine 100 may include an operator cabin 110 and an engine compartment 120. Engine compartment 120 may include fan exhaust system 122, a first canister 124, a second canister 150, and an engine 160. As further illustrated in FIG. 1, engine compartment 120 may be accessed through an access door 206 which may include a hood. Hood 140 may pivotally open (to enable access to engine compartment 120) and close (to restrict access to engine compartment 120). As illustrated in FIG. 1, hood 140 may be in an open position. As further illustrated in FIG. 1, machine 100 may also include a rear set of ground engaging members 170 (or rear ground engaging members 170), a front set of ground engaging members 180 (front ground engaging members 180), and a work tool 190.

The number of components shown in FIG. 1 is provided for explanatory purposes. In practice, there may additional components, fewer components, different components, or differently arranged components than those shown in FIG. 1.

Figure 2:
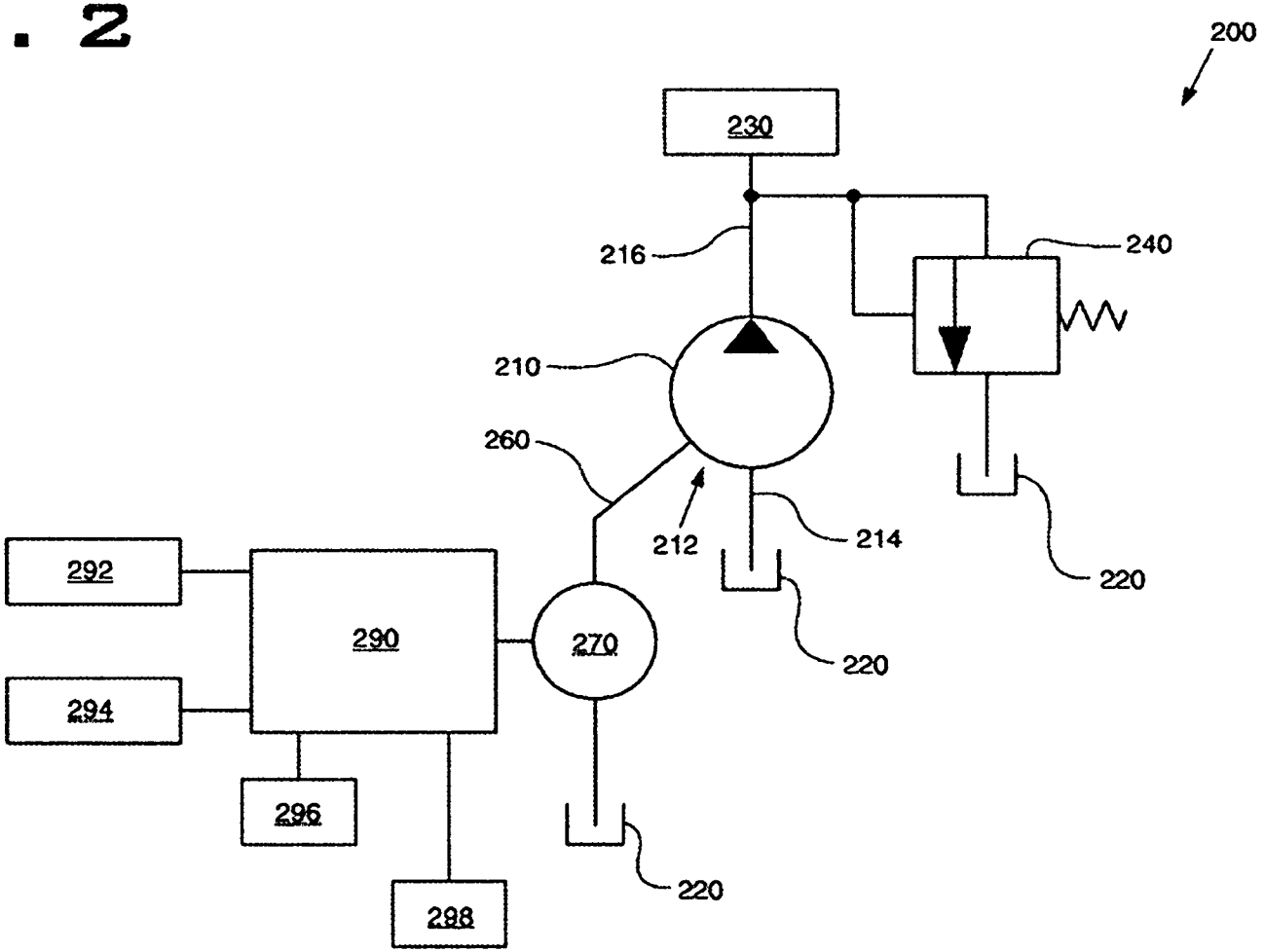
FIG. 2 is a diagram of example components of the machine of FIG. 1.

FIG. 2 is a diagram of example components 200 of machine 100 of FIG. 1. The example components 200 may be implemented using hardware, software, and/or a combination of hardware and software. In some implementations, the example components 200 may be interconnected using wired connections, wireless connections, and/or a combination of wired connections and wireless connections.

The example components 200 may include a hydraulic pump 210 with an inlet line 214 connected to a hydraulic tank 220 and a main discharge line 216. In some implementations, hydraulic pump 210 may include an axial piston pump and may provide power to one or more of the components of machine 100 (e.g., work tool 190). A illustrated in FIG. 2, the main discharge line 216 may be connected to a group of valves 230 that direct fluid (e.g., hydraulic fluid) to a work tool (e.g., work tool 190) selected by an operator of machine 100. In some implementations, the fluid may be a pressurized hydraulic fluid. As further illustrated in FIG. 2, the main discharge line 216 may also be connected to a relief valve 240. The hydraulic pump 210 may also include a case drain 212 that may provide a passage for the fluid to flow from a pump case to hydraulic tank 220.

As further illustrated in FIG. 2, the example components 200 may include a system for hydraulic pump health monitoring 270 (or health monitoring system 270) which may be connected to case drain 212. In some implementations, health monitoring system 270 may be used to determine a health of hydraulic pump 210 based on attributes of the fluid flowing via case drain 212. For example, and as will be explained in more detail below, health monitoring system 270 may measure a temperature of the fluid (e.g., passing from the hydraulic pump 210 back to the hydraulic tank 220 through a case drain line 260), a pressure of the fluid, and/or a quantity of particles in the fluid which may be used to determine the health of hydraulic pump 210.

As further illustrated in FIG. 2, the health monitoring system 270 may further be connected to an electronic control module (ECM) 290 (or a controller 290). In some implementations, ECM 290 may include any type of device or any type of component that may interpret and/or execute information and/or instructions stored within memory 292 to perform one or more functions. For example, ECM 290 may use the information and/or execute the instructions to determine a flow (or a flow rate) of the fluid flowing via case drain 212 based on the temperature of the fluid and the pressure of the fluid (measured by health monitoring system 270) and/or to determine a level of quality of the fluid based on the quantity of particles measured by health monitoring system 270. In some implementations, ECM 290 may include a processor (e.g., a central processing unit, a graphics processing unit, an accelerated processing unit), a microprocessor, and/or any processing logic (e.g., a field-programmable gate array ("FPGA"), an application-specific integrated circuit ("ASIC"), etc.), and/or any other hardware and/or software. In some implementations, ECM 290 may transmit, via a network (not shown), information regarding the flow of the fluid and the level of quality of the fluid.

As further illustrated in FIG. 2, ECM 290 may be connected to a memory 292, a display 294, an input device 296, and a communication interface 298. Memory 292 may include a random access memory ("RAM"), a read only memory ("ROM"), and/or another type of dynamic or static storage device (e.g., a flash, magnetic, or optical memory) that stores information and/or instructions for use by the example components, including the information and/or instructions used by ECM 290 (as explained above). Additionally, or alternatively, memory 292 may include non-transitory computer-readable medium or memory, such as a disc drive, flash drive, optical memory, read-only memory (ROM), or the like. In some implementations, memory 310 may store the information and/or the instructions in one or more data structures, such as one or more databases, tables, lists, trees, etc.

In some implementations, with respect to the information and/or the instructions for use by the example components, memory 292 may store pump health information (or information that may be used to determine the health of hydraulic pump 210). The pump health information may include information regarding the temperature of the fluid (measured by health monitoring system 270), information regarding the pressure of the fluid (measured by health monitoring system 270), information regarding the quantity of particles in the fluid (measured by health monitoring system 270), the information regarding the flow of the fluid and the level of quality of the fluid, information for determining the flow of the fluid based on the temperature of the fluid and the pressure of the fluid (e.g., equation(s), algorithm(s), etc.), information for determining a bypass flow of the fluid based on a total flow of the fluid (e.g., equation(s), algorithm(s), etc.), information identifying a frequency for determining the health of hydraulic pump 210, and/or the like.

Display 294 may include any type of device or any type of component that may display information. For example, display 294 may display a portion of (or an entirety of) the pump health information. In some implementations, display 294 may be a liquid crystal display (LCD), a light-emitting diode (LED) display, an organic light-emitting diode (OLED) display, and/or the like.

Input device 296 may include a component that permits a user to input information to one or more other components of the example components 200. For example, the information, input by the user, may include a preference (of the user) for a frequency for monitoring and/or determining the health of hydraulic pump 210. Additionally, or alternatively, the information, input by the user, may include a manner (e.g., equation(s), algorithm(s), parameters(s), etc.) for monitoring and/or determining the health of hydraulic pump 210. In some embodiments, input device 296 may include a keyboard, a keypad, a mouse, a button, a camera, a microphone, a switch, a touch screen display, and/or the like.

Communication interface 298 may include a transceiver-like component, such as a transceiver and/or a separate receiver and transmitter that enables ECM 290 (and/or other components of machine 100) to communicate with other devices, such as via a wired connection, a wireless connection, or a combination of wired and wireless connections. For example, communication interface 298 may include an Ethernet interface, an optical interface, a coaxial interface, an infrared interface, a radio frequency ("RF") interface, a universal serial bus ("USB") interface, or the like. In some implementations, ECM 290 may cause communication interface 298 to transmit the pump health information (e.g., to a back office system, another machine, etc.).

The number of components shown in FIG. 2 is provided for explanatory purposes. In practice, there may additional components, fewer components, different components, or differently arranged components than those shown in FIG. 2. For example, in some implementations, one or more of the example components 200 may be included in a back office. For example, ECM 290, memory 292, display 294, input device 296 and/or communication interface 298 may be located in a back office while other one or more of components 200 may be located in machine 100. In this regard, health monitoring system 270 may transmit information (e.g., the temperature of the fluid, the pressure of the fluid, and/or the quantity of particles) to ECM 290, memory 292, display 294, input device 296, and/or communication interface 298 located in the back office.

Figure 3:
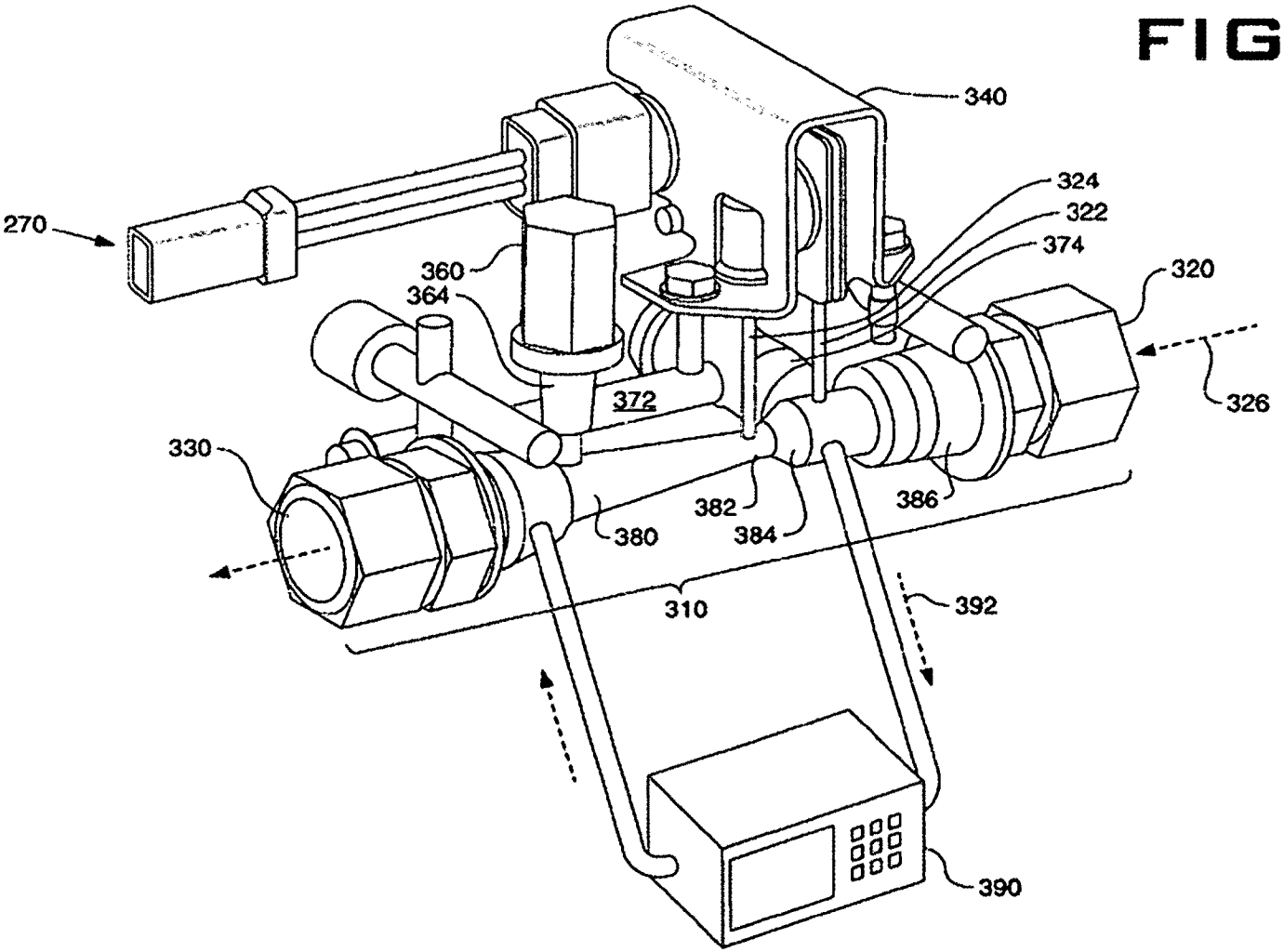
FIG. 3 is a diagram of example components of a system for hydraulic pump health monitoring of the machine of FIG. 1.

FIG. 3 is a diagram of example components of system 270 of machine 100. As illustrated in FIG. 3, system 270 may include a conduit with a Venturi geometry. In some implementations, the conduit may be a manifold 310 with a Venturi geometry. As illustrated in FIG. 3, the Venturi geometry of manifold 310 may include different portions, such a convergent portion 384, a throat portion 382 (or throat 382), and a divergent portion 380. The throat portion may be a constricted portion of the Venturi geometry. In some implementations, manifold 310 may define a fluid path 326. As illustrated in FIG. 3, manifold 310 may include an inlet 320 configured for fluid connection to the case drain 212 and an outlet 330 that may drain fluid to the hydraulic tank 220. As shown, inlet 320 and outlet 330 may have female threaded connections and may, therefore, each be configured to receive a male threaded connection. In some implementations, inlet 320 and outlet 330 may connect to case drain 212 using other types of threaded connections and/or other types of connections.

In some implementations, the Venturi geometry of manifold 310 may enable the pressure of the fluid to be determined. In this regard, and as illustrated in FIG. 3, a differential pressure sensor 340 (or pressure sensor 340) may be connected to manifold 310. Pressure sensor 340 may include any type of device(s) or any type of component(s) that may sense (or detect) a pressure of fluid. Pressure sensor 340 may determine or obtain a pressure of the fluid at inlet 320 through a first pressure port 322 and obtain a pressure of the fluid at the throat 382 through a second pressure port 224. For example, a pressure differential (or delta pressure) of the fluid may be measured between inlet 320 and throat 382 (e.g., a difference between a pressure of the fluid at approximately inlet 320 and a pressure of the fluid at approximately throat 382). In this regard, the flow of the fluid (or total flow of the fluid in manifold 310) may be calculated using the pressure of the fluid (or the delta pressure). In some implementations, the flow of the fluid may be calculated using the delta pressure and the area of an inlet and an outlet of the convergent portion 384.

In some implementations, pressure sensor 340 may transmit information regarding the pressure of the fluid at inlet 320 and the pressure of the fluid at throat 382 (as the information regarding the pressure of the fluid) to ECM 290 to enable ECM 290 to determine the pressure of the fluid. Additionally, or alternatively, pressure sensor 340 may determine the pressure of the fluid based on the pressure of the fluid at inlet 320 and the pressure of the fluid at the throat 382 and may transmit information regarding the pressure of the fluid to ECM 290.

As further illustrated in FIG. 3, system 270 may further include a temperature sensor 360 connected to manifold 310. Temperature sensor 360 may include any type of device(s) or any type of component(s) that may sense (or detect) a temperature of fluid. In some implementations, temperature sensor 360 may determine or obtain a temperature of the fluid and may transmit information regarding the temperature of the fluid to ECM 290. In some implementations, temperature sensor 360 may be a thermistor. As illustrated in FIG. 3, temperature sensor 360 may be disposed in a bore 364 intersecting fluid path 326. It will be appreciated that the temperature of the fluid may be measured without direct contact between temperature sensor 360 and the fluid. For example, the fluid may contact a stainless steel shell residing in the bore 364 and temperature sensor 360 may measure the temperature of the stainless steel shell as the temperature of fluid.

As further illustrated in FIG. 3, system 270 may also include a passage 372 connected downstream with respect to case drain 212. In some implementations, passage 372 may provide an alternative fluid path for fluidly connecting inlet 220 to outlet 230. Passage 372 may include a valve 374 that regulates an amount of fluid that may be directed away from fluid path 326 and may flow through passage 372 to outlet 330. In some implementations, valve 374 may be operated ECM 290 based on the flow of the fluid at a specific temperature, to avoid a back pressure on hydraulic pump 210. Additionally, or alternatively, valve 374 may be self-calibrated to bypass a portion of the fluid through passage 372 if the flow on the inlet side of valve 374 exceeds an inlet threshold.

As further illustrated in FIG. 3, system 270 may further include a particle counter 390. Particle counter 390 may include any type of device or any type of component that may count a quantity of particles and identify a size of the particles. In some implementations, particle counter 390 may measure a quantity of particles in a portion of the flow of the fluid in manifold 310 (or a bypass flow of the fluid), identify a size of the particles, and transmit information regarding the particles (e.g., the quantity of the particles and/or the size of the particles) to ECM 290 to enable ECM 290 to determine a quality of the fluid. As illustrated in FIG. 3, particle counter 390 may be connected to manifold 310 between a portion of manifold 310 that includes the Venturi geometry. In this regard, the bypass flow may follow a fluid path 392 from manifold 310 through particle counter 390 and back to manifold 310. In some implementations, particle counter 390 may be an optical particle counter that may include a light source, that emits lights through the fluid, and may include a sensor that detects obstruction of the light and detects a particle based on the obstruction of the light. For example, particle counter 390 may transmit, to ECM 290, a signal (e.g., a voltage) each time a particle is detected. For instance, a magnitude of the signal may be indicative of a size of the particle. In some implementations, the light source may be a laser and/or any other source that may emit light. In some implementations, particle counter 390 may transmit, to ECM 390, information regarding the particles, such as information identifying a quantity of the particles, a size of each of the particles, and/or the like.

The number of components shown in FIG. 3 is provided for explanatory purposes. In practice, there may additional components, fewer components, different components, or differently arranged components than those shown in FIG. 3.

For example, temperature sensor 360 may be included at different location along fluid path 326 and/or manifold 310. Additionally, or alternatively, system 270 may include multiple pressure sensors (e.g., one pressure sensor at approximately inlet 320 and another pressure sensor at approximately throat 382). In this regard, each pressure sensor may obtain a pressure of the fluid at a respective location and may transmit the pressure to ECM 290 to determine the pressure of the fluid (or the delta pressure of the fluid). Additionally, or alternatively, system 270, ECM 290, memory 292, display 294, input device 296 and/or communication interface 298 may be part of a system.

Figure 4:
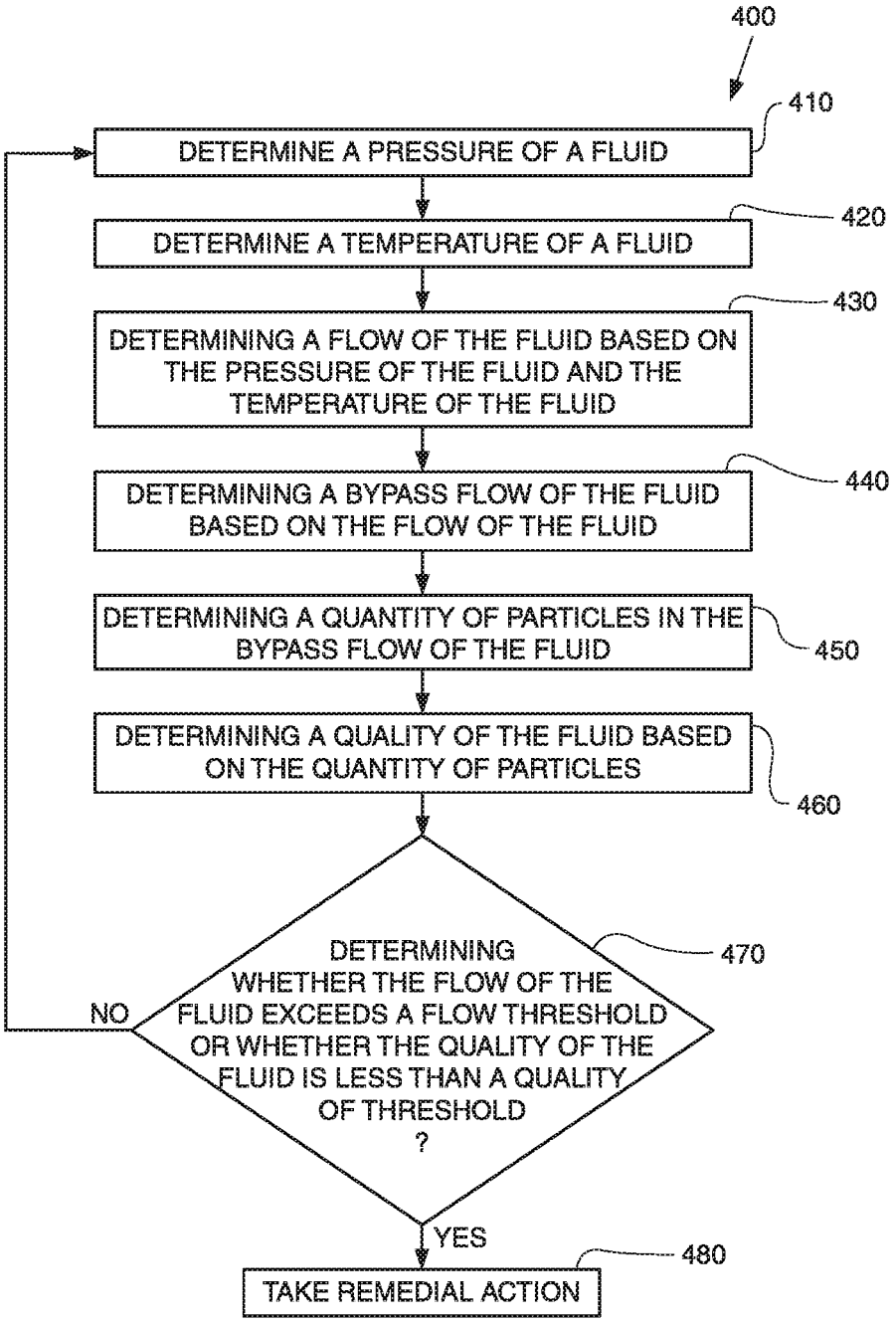
FIG. 4 is a flow chart of an example process for monitoring of the health of a hydraulic pump of the machine of FIG. 1.

FIG. 4 is a flow chart of an example process for monitoring of the health of hydraulic pump 210 of machine 100 of FIG. 1. In some implementations, one or more process blocks of process 400 may be performed by ECM 290 and/or system 270. For example, ECM 290 and/or system 270 may perform one or more process blocks of process 400 automatically (e.g., without intervention/input from an operator of machine 100). In some implementations, one or more process blocks of FIG. 4 may be performed by another device or a group of devices separate from or including ECM 290 and system 270, such as the back office system.

As shown in FIG. 4, process 400 may include determining a pressure of a fluid (block 410). For example, pressure sensor 340 may measure a pressure of a fluid (e.g., hydraulic fluid) flowing through manifold 310. In some implementations, pressure sensor 340 may measure a pressure of the fluid at inlet 320 through a first pressure port 322 and measure a pressure of the fluid at throat 282 through a second pressure port 324. In some implementations, pressure sensor 340 may determine the pressure of the fluid as a delta pressure (or differential pressure) of the fluid using the pressure of the fluid at inlet 320 and the pressure of the fluid at throat 282. For example, pressure sensor 340 may determine the delta pressure of the fluid by subtracting the pressure of the fluid at throat 282 from the pressure of the fluid at inlet 320. In some implementations, the delta pressure of the fluid may be determined using another mathematical combination of the pressure of the fluid at throat 282 and the pressure of the fluid at inlet 320. Pressure sensor may transmit information regarding the pressure of the fluid to ECM 290. In some implementations, pressure sensor 340 may transmit information regarding the pressure of the fluid at inlet 320 and the pressure of the fluid at throat 282 to ECM 290. In this regard, ECM 290 may determine the pressure of the fluid (or the delta pressure of the fluid) using the pressure of the fluid at inlet 320 and the pressure of the fluid at throat 282 in a manner similar to that described above. In some implementations, ECM 290 may cause pressure sensor 340 to measure the pressure of the fluid at approximately inlet 320 and measure the pressure of the fluid at approximately throat 282. Additionally, or alternatively, pressure sensor 340 may measure the pressure of the fluid at inlet 320 and measure the pressure of the fluid at throat 282 independently of ECM 290.

As further shown in FIG. 4, process 400 may include determining a temperature of the fluid (block 420). For example, temperature sensor 360 may measure a temperature of the fluid flowing through manifold 310 and may transmit information regarding the temperature of the fluid to ECM 290. In some implementations, ECM 290 may cause temperature sensor 360 to measure the temperature of the fluid. Additionally, or alternatively, temperature sensor 360 may measure the temperature of the fluid independently of ECM 290.

As further shown in FIG. 4, process 400 may include determining a flow of the fluid based on the pressure of the fluid and the temperature of the fluid (block 430). For example, ECM 290 may determine a flow (or flow rate) of the fluid, flowing through manifold 310, based on the pressure of the fluid (from information regarding the pressure of the fluid) and the temperature of the fluid (from information regarding the temperature of the fluid). In some implementations, ECM 290 may determine the flow of the fluid based on a relationship between flows of fluids with respect to pressures (or delta pressures) of the fluids and the temperatures of the fluids. The relationship may be based on one or more experiments, field studies, analyses, simulations, and/or the like. For example, results of the one or more analyses, experiments, field studies, simulations, and/or the like may identify a corresponding flow for each pressure of fluid and each temperature of fluid. Accordingly, based on the relationship along with the pressure of the fluid and the temperature of the fluid, ECM 290 may determine the flow of the fluid flowing through manifold 310. In some implementations, information regarding the relationship may be included in the information for determining the flow of the fluid based on the temperature of the fluid and the pressure of the fluid. Accordingly, ECM 290 may obtain the pump health information from memory 292, identify the information for determining the flow of the fluid, and determine the relationship based on the information for determining the flow of the fluid. In some implementations, the flow of the fluid may be measured in liter per minute. Additionally, or alternatively, the flow of the fluid may be measured in any unit of measurement that indicates a volume of fluid per a period of time.

As further shown in FIG. 4, process 400 may include determining a bypass flow of the fluid based on the flow of the fluid (block 440). For example, ECM 290 may determine a bypass flow of the fluid, flowing from manifold 310 through particle counter 390, based on the flow of the fluid. For instance, the bypass flow of the fluid may correspond to a portion of the flow of the fluid (or total flow of the fluid) that is directed to (or re-directed through) particle counter 390. In some implementations, ECM 290 may determine the bypass flow of the fluid based on a relationship between the flows of fluid and bypass flows of fluids. The relationship may be based on one or more experiments, field studies, analyses, simulations, and/or the like. For example, results of the one or more analyses, experiments, field studies, simulations, and/or the like may identify a corresponding bypass flow for total flow. Accordingly, based on the relationship and the total flow, ECM 290 may determine the bypass flow of the fluid flowing from manifold 310 to particle counter 390. In some implementations, information regarding the relationship between the total flows and the bypass flows may be included in the information for determining the bypass flow of the fluid based on the total flow of the fluid. Accordingly, ECM 290 may obtain the pump health information from memory 292, identify the information for determining the bypass flow of the fluid based on the flow of the fluid, and determine the relationship between the flows and the bypass flows. The relationship may identify a portion of the flow that is typically directed to (or re-directed through) particle counter 390.

As further shown in FIG. 4, process 400 may include determining a quantity of particles in the bypass flow of the fluid (block 450). For example, particle counter 390 may determine a quantity of particles in the bypass flow of the fluid, may determine a size of each of the particles in the bypass flow of the fluid, and transmit information regarding the particles (e.g., the quantity of the particles and/or the size of the particles) to ECM 290 to determine a quality of the fluid. For example, particle counter 390 may transmit, to ECM 290, a signal (e.g., a voltage) each time a particle is detected based on an obstruction of light. For instance, a magnitude of the signal may be indicative of a size of the particle. In some implementations, particle counter 390 may transmit to ECM 292 a signal (e.g., voltage) each time a particle passes through the laser. ECM 292 may receive the signal, count a particle each time the signal, and determine a size of particle based on the signal. In some implementations, the light source may be a laser and/or any other source that may emit light. In some implementations, particle counter 390 may transmit, to ECM 390, information regarding the particles, such as information identifying a quantity of the particles, a size of each of the particles, and/or the like. In some implementations, ECM 290 may cause particle counter 390 to count the quantity of particles and/or determine a size of the particles. Additionally, or alternatively, particle counter 390 may count the quantity of particles and/or determine a size of the particles independently of ECM 290.

As further shown in FIG. 4, process 400 may include determining a quality of the fluid based on the quantity of particles (block 460). For example, ECM 290 may determine the quality of the fluid (or a cleanliness of the fluid) based on the information regarding the particles (e.g., information identifying a quantity of the particles, a size of each of the particles, and/or the like). For instance, ECM 290 may consider the quantity of particles and the size of the particles with respect to the bypass flow. In other words, ECM 290 may compare the quantity of particles and the size of the particles to a volume of the fluid (and/or a volume of the fluid over a period of time). Accordingly, the quality of the fluid may be based on the quantity of particles and the size of each of the particles in the bypass flow. In some implementations, ECM 290 may determine information indicative of the quality of the fluid based on the quantity of particles, the size of each of the particles, and the bypass flow (e.g., the volume of the fluid). For example, ECM 290 may generate standardized information indicative of the quality of the fluid (or a unit of measurement of the quality of the fluid) based on the quantity of particles, the size of each of the particles, and the bypass flow (e.g., the volume of the fluid). For instance, ECM 290 may generate a cleanliness code, of the International Organization for Standardization (ISO), based on the quantity of particles, the size of each of the particles, and the bypass flow (e.g., the volume of the fluid). In some implementations, one or more other units of measurement may be used to indicate the quality of the fluid.

As further shown in FIG. 4, process 400 may include determining whether the flow of the fluid exceeds a flow threshold or whether the quality of the fluid is less than a quality threshold (block 470). For example, ECM 290 may determine whether the total flow of the fluid exceeds the flow threshold and/or whether the quality of the fluid is less than the quality threshold to determine the health of hydraulic pump 210 (and/or the health of other components of machine 100). In some implementations, the total flow of the fluid exceeding the flow threshold and/or the quality of the fluid being less than the quality threshold may be indicative of a failure or an impeding failure of hydraulic pump 210 (and/or other components of machine 100). Accordingly, ECM 290 may predict a failure of hydraulic pump 210, detect a failure of hydraulic pump 210, and/or detect an impeding failure of hydraulic pump 210 based on the total flow of the fluid and/or the quality of the fluid. For example, ECM 290 may predict the failure of hydraulic pump 210, detect the failure of hydraulic pump 210, and/or detect the impeding failure of hydraulic pump 210 based on the total flow of the fluid exceeding the flow threshold and/or the quality of the fluid being less than the quality threshold. Accordingly, ECM 290 may monitor the health of hydraulic pump 210 based on the total flow of the fluid and/or the quality of the fluid.

As further shown in FIG. 4, if the flow of the fluid does not exceed the flow threshold and the quality of the fluid is not less than the quality threshold, (block 470—NO), then process 400 may return to block 410. In some implementations, ECM 290 may cause display 294 to display information regarding hydraulic pump 210, the flow of the fluid, and/or the quality of the fluid. For example, ECM 290 may cause display 294 to display information indicating that hydraulic pump 210 is healthy, that the flow of the fluid does not exceed the flow threshold (or is within an acceptable range), and/or that the quality of the fluid meets the quality threshold (or is within an acceptable). In some implementations, ECM 290 may predict when the flow of the fluid may exceed the flow threshold and/or when the quality of the fluid may fall below the quality threshold and, consequently, predict when hydraulic pump 210 may be experiencing a failure. In this regard, ECM 290 may cause display 294 to display pump maintenance. The pump maintenance may include information regarding the prediction and information regarding (instructions for) preventing the flow of the fluid from exceeding the flow threshold, preventing the quality of the fluid from falling below the quality threshold, and/or preventing hydraulic pump 210 from experiencing the failure.

As further shown in FIG. 4, if the flow of the fluid exceeds the flow threshold and/or the quality of the fluid is less than the quality threshold, (block 470—YES), then process 400 may include taking remedial action (block 480). For example, if ECM 290 determines that the flow of the fluid exceeds the flow threshold and/or that the quality of the fluid is less than the quality threshold, ECM 290 may take a remedial action. In some implementations, the remedial action may include causing pump failure information to be displayed via display 294. For example, the pump failure information may indicate that the total flow of the fluid has exceeded the flow threshold and that hydraulic pump 210 may be damaged and/or may fail if hydraulic pump 210 continues to be used (or, in other words, if hydraulic pump 210 is not serviced). Additionally, or alternatively, the information may indicate that engine 160 is to be shut down or derated to prevent additional wear and/or damage to hydraulic pump 210, that hydraulic pump 210 is to be serviced, and/or the like. Additionally, or alternatively, the pump failure information may include instructions for servicing hydraulic pump 210 (e.g., replacing and/or repairing hydraulic pump 210), information identifying a location of hydraulic pump 210, and/or the like. In some implementations, the pump failure information may be transmitted to a remote location (e.g., a back office system) and/or another device. For example, ECM 290 may cause the pump failure information to be transmitted to the remote location and/or the other machine.

Additionally, or alternatively, the remedial action may include causing service instructions to be provided. Additionally, or alternatively, the remedial action may include causing service of hydraulic pump 210 to be automatically scheduled. Additionally, or alternatively, the remedial action may include modifying an operation of engine 160, an operation of work tool 190 (which may powered by hydraulic pump 210), an operation of other components of machine 100 (which may powered by hydraulic pump 210), and/or the like. For example, ECM 290 may cause engine 160 to slow down, decelerate, and/or be shut down to prevent additional damage to hydraulic pump 210 and/or engine 160. Additionally, or alternatively, ECM 290 may cause work tool 190 to be locked or disabled, may cause a range of motion of work tool 190 to be limited, and/or the like.

In some implementations, each remedial action described above may be associated with a respective level of total flow of the fluid and/or the quality of the fluid. Accordingly, ECM 290 may select a remedial action based on the total flow of the fluid and/or the quality of the fluid.

In some implementations, blocks 410 to 480 may be repeated in periodically. For example, ECM 290 may obtain, from memory 292, pump health information which may include the information identifying the frequency for determining the health of hydraulic pump 210. ECM 290 may cause blocks 410 to 480 to be repeated based on the information identifying the frequency for determining the health of hydraulic pump 210.

INDUSTRIAL APPLICABILITY

The present disclosure finds utility in various industrial applications, such as in transportation, mining, construction, industrial, earthmoving, agricultural, and forestry machines and equipment. For example, the present disclosure may be applied to hauling machines, dump trucks, mining vehicles, on-highway vehicles, off-highway vehicles, trains earthmoving vehicles, agricultural equipment, material handling equipment, and/or the like. More particularly, the present disclosure relates to monitoring the health of the hydraulic pump to be prevent failure of the hydraulic pump and other components of hydraulic pump and/or of machine 100.

No element, act, or instruction used herein should be construed as critical or essential unless explicitly described as such. so, as used herein, the articles "a" and "an" are intended to include one or more items, and may be used interchangeably with "one or more." Furthermore, as used herein, the term "set" is intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of determining health of a hydraulic pump of a machine, the method comprising:

receiving, by an electronic control module of the machine and from a first sensor of the machine, information regarding a pressure of a fluid in a case drain providing a passage from the hydraulic pump to a hydraulic tank of the machine;

receiving, by the electronic control module and from a second sensor of the machine, information regarding a temperature of the fluid in the case drain;

determining, by the electronic control module, a flow of the fluid in the case drain based on the information regarding the pressure and the information regarding the temperature;

determining, by the electronic control module, a portion of the flow of the fluid in the case drain that is directed to a particle counter of the machine;

receiving, by the electronic control module and from the particle counter, information regarding particles in the portion of the flow of the fluid;

determining, by the electronic control module, a quality of the fluid in the case drain based on the information regarding the particles in the portion of the flow of the fluid;

determining, by the electronic control module, whether the flow of the fluid in the case drain exceeds a flow threshold or whether the quality of the fluid in the case drain is less than a quality threshold to determine the health of the hydraulic pump; and taking, by the electronic control module, a remedial action when at least one of the flow of the fluid in the case drain exceeds the flow threshold or the quality of the fluid in the case drain is less than the quality threshold.

2. The method of claim 1, where receiving information regarding the pressure of the fluid in the case drain includes receiving information regarding a differential pressure of the fluid.

3. The method of claim 2, where the fluid in the case drain flows through a conduit of the machine, where the conduit of the machine includes a Venturi geometry, and where the differential pressure of the fluid in the case drain corresponds to a differential pressure between an inlet portion of the conduit and a constricted portion of the Venturi geometry.

4. The method of claim 1, further comprising:

detecting a failure of the hydraulic pump based on at least one of the flow of the fluid in the case drain or the quality of the fluid in the case drain.

5. The method of claim 1, further comprising:

predicting a failure of the hydraulic pump based on at least one of the flow of the fluid in the case drain or the quality of the fluid in the case drain.

6. The method of claim 1, where taking the remedial action includes:

causing an engine of the machine to at least one of slow down, decelerate, or shut down to prevent additional damage to the hydraulic pump.

7. The method of claim 1, where taking the remedial action includes:

causing a work tool of the machine to be disabled; or causing a range of motion of the work tool to be limited.

8. A system comprising:

a first sensor configured to transmit information regarding a pressure of a fluid in a case drain providing a passage from a hydraulic pump to a hydraulic tank of a machine;

a second sensor configured to transmit information regarding a temperature of the fluid in the case drain; and an electronic control module configured to:

determine a flow of the fluid in the case drain based on the information regarding the pressure and the information regarding the temperature;

determine a portion of the flow of the fluid in the case drain that is directed to a particle counter of the machine;

receive, from the particle counter, information regarding particles in the portion of the flow of the fluid;

determine a quality of the fluid in the case drain based on the information regarding the particles in the portion of the flow of the fluid;

determine whether the flow of the fluid in the case drain exceeds a flow threshold or whether the quality of the fluid in the case drain is less than a quality threshold; and take a remedial action when at least one of the flow of the fluid in the case drain exceeds the flow threshold or the quality of the fluid in the case drain is less than the quality threshold.

9. The system of claim 8, where, when receiving the information regarding the pressure of the fluid in the case drain, the electronic control module is to:

receive information regarding a differential pressure of the fluid in the case drain.

10. The system of claim 9, where the fluid in the case drain flows through a conduit of the machine via a case drain, where the conduit of the machine includes a Venturi geometry, and where the differential pressure of the fluid in the case drain corresponds to a differential pressure between an inlet portion of the conduit and a constricted portion of the Venturi geometry.

11. The system of claim 10, where the temperature corresponds to a temperature of the fluid in the case drain within a portion of the Venturi geometry.

12. The system of claim 8, where the electronic control module is further configured to:

detect a failure of a hydraulic pump of the machine based on at least one of the flow of the fluid in the case drain or the quality of the fluid in the case drain.

13. The system of claim 8, where the electronic control module is further configured to:

predict a failure of a hydraulic pump of the machine based on at least one of the flow of the fluid in the case drain or the quality of the fluid in the case drain.

14. The system of claim 8, where, when taking the remedial action, the electronic control module is to:

causing an engine of the machine to at least one of slow down, decelerate, or shut down.

15. The system of claim 8, where, when taking the remedial action, the electronic control module is to:

disable a work tool of the machine; or limit a range of motion of the work tool.

16. A machine comprising:

a first sensor configured to transmit information regarding a pressure of a fluid in a case drain providing a passage from a hydraulic pump to a hydraulic tank of the machine;

a second sensor configured to transmit information regarding a temperature of the fluid in the case drain; and an electronic control module configured to:

determine a flow of the fluid in the case drain based on the information regarding the pressure and the information regarding the temperature;

determine a portion of the flow of the fluid in the case drain that is directed to a particle counter of the machine;

receive, from the particle counter, information identifying a quantity of particles in the portion of the flow of the fluid;

determine a quality of the fluid in the case drain based on the quantity of particles in the portion of the flow of the fluid;

determine whether the flow of the fluid in the case drain exceeds a flow threshold or whether the quality of the fluid in the case drain is less than a quality threshold; and take a remedial action when at least one of the flow of the fluid in the case drain exceeds the flow threshold or the quality of the fluid in the case drain is less than the quality threshold.

17. The machine of claim 16, where, when receiving the information regarding the pressure of the fluid in the case drain, the electronic control module is to:

receive information regarding a differential pressure of the fluid in the case drain.

18. The machine of claim 17, where the fluid in the case drain flows through a conduit of the machine, where the conduit of the machine includes a Venturi geometry, and where the differential pressure of the fluid in the case drain corresponds to a differential pressure between an inlet portion of the conduit and a constricted portion of the Venturi geometry.

19. The machine of claim 16, where the electronic control module is further configured to at least one of:

detect a failure of a hydraulic pump of the machine based on at least one of the flow of the fluid in the case drain or the quality of the fluid in the case drain; or predict a failure of a hydraulic pump of the machine based on at least one of the flow of the fluid in the case drain or the quality of the fluid in the case drain.

20. The machine of claim 16, where, when taking the remedial action, the electronic control module is to at least one of:

causing an engine of the machine to at least one of slow down, decelerate, or shut down;

cause a work tool of the machine to be disabled; or cause a range of motion of the work tool to be limited.

* * * * *